United States Patent [19]

Bortolani et al.

[11] Patent Number: 4,537,011

[45] Date of Patent: Aug. 27, 1985

[54] VACUUM PACKAGING

[75] Inventors: Ermanno Bortolani, Legnano; Sandro Brembilla, Arese, both of Italy; Enzo Vassarotti, Bugnaux S/Rolle, Switzerland

[73] Assignee: W. R. Grace & Co., Cryovac Div., Duncan, S.C.

[21] Appl. No.: 444,956

[22] Filed: Nov. 26, 1982

[30] Foreign Application Priority Data

Apr. 30, 1982 [IT] Italy ..... 21030 A/82

[51] Int. Cl.[3] ..... B65B 11/52

[52] U.S. Cl. ..... 53/509; 53/427

[58] Field of Search ..... 53/427, 509; 206/471, 206/497

[56] References Cited

U.S. PATENT DOCUMENTS

| | | | |
|---|---|---|---|
| 2,958,172 | 11/1960 | Branche | 53/509 X |
| 2,976,658 | 3/1961 | Kostur | 53/509 |
| 3,260,032 | 7/1966 | Hill et al. | 53/509 |
| 3,279,144 | 10/1966 | Larson | 53/427 |
| 3,299,604 | 1/1967 | Kraut | 206/471 X |
| 3,326,372 | 6/1967 | Fineman et al. | 206/471 |
| 3,648,428 | 3/1972 | Colburn | 53/427 X |
| 3,861,529 | 1/1975 | Coleman | 53/427 X |

*Primary Examiner*—John Sipos
*Assistant Examiner*—Donald R. Studebaker
*Attorney, Agent, or Firm*—John J. Toney; William D. Lee, Jr.

[57] ABSTRACT

The invention provides a method of vacuum packing by defining a "dummy product" 17 alongside a product article 14 on a support sheet so that any "webbing" 18 is to the side of that projection 17 which faces away from the adjacent product article 14. That projection 17 can subsequently be trimmed to leave a webbing-free pack. Cutting down webbing reduces the risk of leakage of the pack. Preferably the height of the projection 17 is adjusted in response to the height of a product article 14 so that the extent of such webbing 18 is at a minimum.

3 Claims, 7 Drawing Figures

VACUUM PACKAGING

DESCRIPTION

The present invention provides an improved method and apparatus for producing a vacuum package, and in particular so as to avoid or reduce the incidence of "webbing" around tall products packaged on a relatively flat support.

It is a well known problem that when packaging relatively tall products by placing them on a support board on which a cover sheet is draped while in a heat-softened condition, the cover sheet attaches itself to the support board, as desired, but leaves unsightly "webbing" where folds arise in the cover sheet around the edges of the product. This webbing is particularly undesirable because it gives rise to leakages in the finished package.

We now propose to provide a vacuum package comprising at least one product article on a support, substantially without any wrinkles or webbing around the product in the finished package.

Accordingly, the present invention provides a process for vacuum packaging, comprising placing at least one product article on a support sheet and covering that product article with a cover film sealed to the support sheet with the application of vacuum around the product article or articles and between the support sheet and cover film, such process including providing an upstanding or recess formation on the side of the support sheet to which the cover film is attached during the closing operation, such formation serving as a "cover film collector" to absorb material of the cover film which would otherwise form webbing on the adjacent product article.

The "collector" formation alongside the product article or array of product articles may comprise a thermoformed upstanding rib in the support sheet, or a filler strip laid on the support sheet, or an upstanding marginal rib in the case of a rigid support sheet, or a recess in the support sheet due to local downward deformation. Other ways of achieving the collector formation are well within the capability of the expert in this field.

The present invention also provides a process for vacuum packaging substantially as hereinbefore described with reference to the accompanying drawing.

Finally, the invention provides apparatus for vacuum packaging, comprising: a vacuum chamber adapted to receive a support sheet and a cover film over the support sheet; means for evacuating a space between the cover film and support sheet to form a vacuum pack of the cover film sealed to the support sheet around a product article; and means defining an upstanding or recess formation in the cover film to define a "cover film collector" in the finished pack to absorb cover film material which would otherwise form webbing on a product article being packed.

In order that the present invention may more readily be understood the following description is given, merely by way of example, of one embodiment of a method in accordance with the present invention, in which an array of four product articles is packed simultaneously across a web. This embodiment is described with reference to the accompanying drawings in which.

Figure 1:
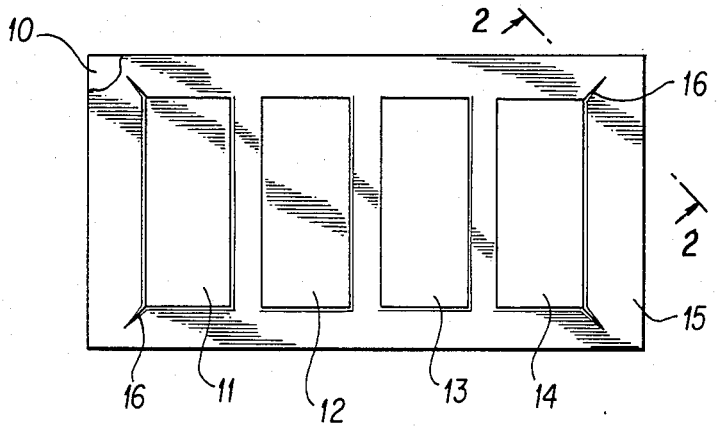
FIG. 1 is a top plan view of a prior art package showing "webbing" formed at the corners of the rectangular array of four rectangular parallelepiped-shaped product articles.

Referring now to the drawings, FIG. 1 shows the package as comprising a support sheet 10 on which are placed product articles 11, 12, 13, 14 which are then covered by a cover film 15.

Figure 2:
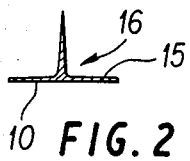
FIG. 2 is a section taken on the line 2—2 of FIG. 1.

At the four corners of the rectangular array of product articles are "webbing" formations 16, one of which is shown in sectional view in FIG. 2.

Figure 3:
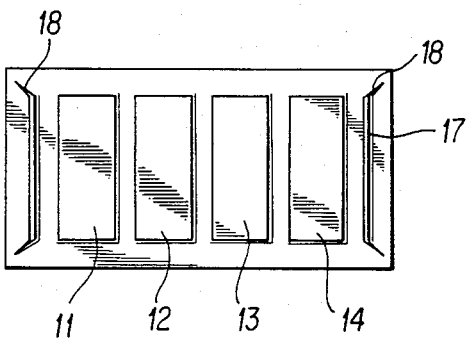
FIG. 3 is a top plan view of a similar package but when formed by the method in accordance with the present invention.

We have now discovered that if a cover film "collector" formation such as a "dummy product"-like formation is arranged alongside an article such as 11, 12, 13 or 14 any "webbing" is formed around that "dummy product" rather than on the nearest adjacent article of the array. Thus, FIG. 3 shows an upstanding rib 17 which, in accordance with one form of the present invention, is positioned alongside the array of product articles. In this case there are two such "dummies" 17, one at each end of the array of product articles and (by careful choice of heights of these "dummies") each attracting a much smaller "webbing" formation 18 extending in a direction towards the adjacent edge of the support sheet 10, and therefore away from the adjacent product article 11 or 14.

In this particular embodiment there are four product articles each of rectangular parallelepiped-shape, and arranged in a rectangular array with the two "dummy products" extending parallel to the shorter sides of that array. However, any other configuration is possible provided the "dummy products" formed in accordance with the present invention are positioned relative to an adjacent product article (which may be the only product article on the support base) such as to avoid the formation of "webbing" with that article.

Figure 4:
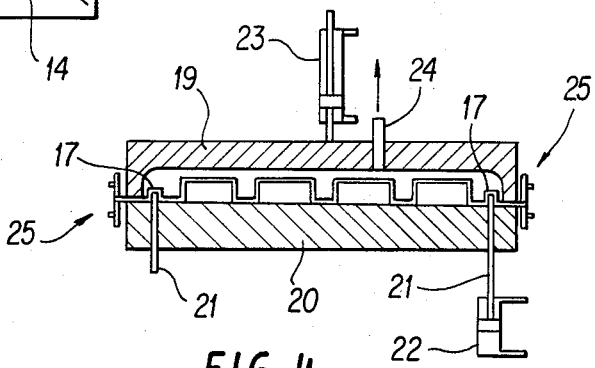
FIG. 4 is a schematic sectional view showing the vacuum chamber closed around the product articles and films during the formation of the package of FIG. 3.

FIG. 4 shows the formation of such a package by placing a cover 19, having a downwardly concave cavity to define a vacuum chamber above the cover film 15, a base 20 co-operating with cover 19.

In this particular embodiment the "dummy products" are in the form of upstanding ribs formed in the support sheet 10 by liftable plates 21 each of which is actuated by a respective fluid pressure-operated ram (either pneumatic or hydraulic) 22 only one of which is shown in FIG. 4.

Figure 5:
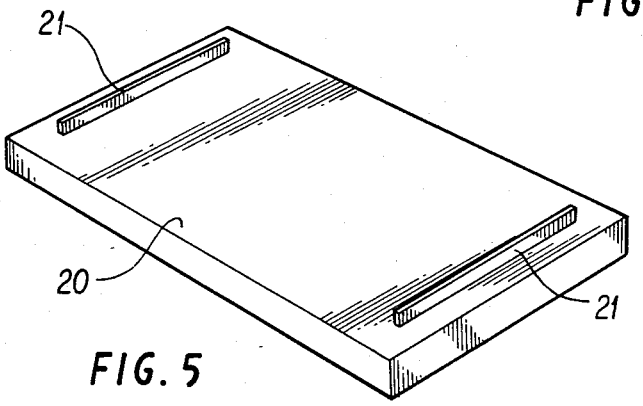
FIG. 5 is an overhead perspective view showing the base portion of the chamber illustrated in FIG. 4.

FIG. 5 shows an overhead perspective view of the base 20 of FIG. 4, including the two "dummy product"-defining plates 21 but, for the purpose of simplicity of illustration, the operating rams 22 have been omitted from this drawing.

The operation of the apparatus of FIGS. 4 and 5, and of the process exemplified by FIGS. 3, 4 and 5 is as follows:-

A continuous support sheet 10 is advanced over the base 20 in a direction parallel to the extent of the two "dummy product"-defining plates 21 to index a fresh portion of the support sheet, with an array of four product articles 11, 12, 13 and 14 thereon, on the base 20, ready to be sealed by the vertical reciprocable cover 19.

In this particular embodiment of the process, the "dummy product"-defining plates 21 are able to be retracted into the base 20 so that the support sheet 10 can be substantially flat as it is moved into position on the base 20. Once the cover film 15 has arrived under the chamber cover 19, the cover 19 descends and the vacuum chamber space defined in the clearance between the cover 19 and the base 20 is evacuated in such a sequence as to draw the cover film 15 down onto the support sheet 10. At this time, or slightly earlier but after closing of the cover 19 onto the base 20, the rams 22 are operated to raise the "dummy product"-defining plates 21 to a position shown in FIG. 4 where they deform the now clamped support sheet 10, and the cover film 15 thereon, upwardly to define the illustrated "dummy product" ribs 17.

Although not mentioned above, it will of course be understood that the cover film 15 is heated before this vacuum draping operation in which it is draped onto the support sheet 10. The heating can be either by means of radiant heaters positioned in the path of the cover film 15 towards the sealing station defined by the chamber cover 19 and the base 20, or alternatively some heating means may be incorporated in the chamber cover 19 and the cover film 15 may be attracted into contact with the hot cavity within the cover 19 by a pressure differential. The latter system will be substantially as disclosed in U.S. Pat. No. 3,694,991 (Perdue et al). Alternative processes may be substantially as disclosed in U.S. Pat. No. 3,491,504 (Young et al), U.S. Pat. No. 3,634,993 (Pasco and Wolfelsperger), U.K. Pat. No. 1,445,285 (Du Pont), U.S. Pat. No. 3,260,032 (Hill et al) or in Modern Packaging (May 1971) at pages 60 to 62.

FIG. 4 shows one form of means for opening and closing the chamber 19, 20, namely a fluid pressure-operated jack 23 programmed to operate in a repetitive cycle coordinated with operation of the feed means 25 for the support sheet 10 and the cover film 15 so that the film-advancing movement occurs while the chamber is open, and the film advance is interrupted as the chamber closes. A suitable vacuum source is connected to the duct 24 for evacuating the space between the support sheet 10 and the cover film 15, the evacuation operation being coordinated, by means of a central programmer, with the operation of the chamber-opening and-closing means in a programme which is well known to the expert in this art.

Although the above description relates to the simultaneous packaging of a set of articles 11, 12, 13, and 14 in a rectangular array extending laterally across a continuous web, any convenient number of such articles, even including only one article, may be packaged during each operating phase of the vacuum chamber 19, 20 defining the sealing station.

Upon completion of the sealing operation, the package will have the configuration shown in FIG. 4 in that the raised "dummy product"-defining ribs 17 will remain in the support sheet 10 and the "webbing" 18 (not shown in FIG. 4) will then extend outwardly towards the margin of the support sheet 10. To enhance this operation, the support sheet 10 may itself be heated so as to undergo a degree of thermoforming in the deformation process.

The chamber cover 19 is then raised, and the composite sheet 10–15 is advanced to a trimming station where the lateral margins of the composite sheet 10, 15, including the remaining "dummy product"-defining ribs 17, are trimmed off and the package shown in FIG. 3 is severed from a continuous strip of such packages having a succession of such rectangular arrays of product articles 11–14 thereon. Optionally, the individual product articles 11, 12, 13 and 14 in each array may then be severed from one another to provide four separate vacuum packages.

It has been found that the process described above considerably reduces the formation of "webbing" and bearing in mind that the webbing is then formed in the selvage at the edge of the composite web the wrinkles can be completely eliminated from the finished package by trimming. Thus the aesthetic appeal of the finished package is much better than with the prior art pack where more substantial corner "webbing" 16 is noticeable.

A rather more important advantage of the present process is that, by appropriate selection of the height of the "dummy product"-defining ribs 17, it is possible to reduce the magnitude of the "webbing" 18 to such an extent that there will no longer be a risk of leakage of the finished pack. In any case, bearing in mind that the "webbing" 18 is now formed at the "dummy product"-defining ribs 17 away from the corners of the array of product articles 11–14, this array itself is substantially free of "webbing". It is, after all, vacuum on the product articles themselves which is being aimed for and thus it is the occurrence of "webbing" at those corners which could give rise to unacceptable leakage; this has been avoided by the process of the present invention.

As indicated above, the height of the "dummy product"-defining ribs 17 is preferably adjustable and consequently the raised position of each of the plates 21 is preferably itself adjustable by means such as the rams 22 shown in FIG. 4, so as to allow optimisation of the height of the ribs 17 in dependence on the heights of the individual product articles 11–14. If desired the plates 21 may be normally fixed in use of the apparatus but adjustable in height to allow for different heights of product. Likewise the height of the cavity in the underside of the cover 19 may be adjustable as disclosed in U.S. Pat. No. 3,835,618.

As will be appreciated, the apparatus illustrated in FIG. 4 is particularly advantageous in that it does not require the presence of partition walls between the individual product articles and consequently the same chamber configuration can be used for various different layouts of product articles on the support sheet 10.

An alternative embodiment of the process is one in which the plates 21 are no longer required but, instead, "dummy products" in the form of filler strips are laid on the support sheet 10 in the selvage region where the ribs 17 arise in FIGS. 3 and 4. These "dummy products" are preferably disposable items so that they can be discarded with the trimmed selvage at the subsequent trimming station.

Figure 7:
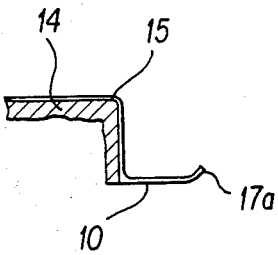
FIG. 7 is a detail, on the same section line as FIG. 4, but showing the lateral edge of a generally flat horizontal tray extending upwardly to serve as a cover film collector.

A further possibility (see FIG. 7), particularly suitable in the case of packaging using relatively stiff backing boards, such as an expanded polystyrene tray coated with an air-impervious surface film to facilitate vacuum packaging, is one in which the lateral edges 17*a* of a generally flat horizontal tray extend upwardly to define "dummy product" formations which will attract the "webbing" and can then be trimmed off as with the embodiment of package shown in FIG. 4.

It is not essential for the various product articles 11, 12, 13 and 14 to be severed from one another. It would instead be possible to package simultaneously four separate product articles which will be sold in a "consume some-save some" pack enabling the consumer to cut open each of the four product-containing "bubbles" separately. The display of such a pack may even be effected with the aid of one or both of the "dummy product" formations left on the pack to enable the pack to be suspended, for example by placing it on two closely adjacent rails which pass between a "dummy product" formation 17 and the nearest product article 11 or 14. This is applicable in the case of relatively stiff support sheets 10 in which the "dummy product" formation will be sufficiently rigid to support the weight of the pack.

Otherwise, suspension display of the individual product articles 11, 12, 13 and 14 can be achieved by punching a suspension display hole (not shown) in the peripheral zone of the pack containing such an individual product article, the punching operation taking place simultaneously with the operation of severing the articles one from another.

Any suitable medium may be used for the support sheet, ranging from a single or multi-layer film preferably having a heat-sealable upper surface, to a rigid or semi-rigid material, for example the above-mentioned expanded polystyrene board having a coating on its upper surface to hold vacuum and, preferably, to render it heat-sealable. Instead of heat sealing, self-welding may be employed as the sealing mechanism, or an adhesive action may be used. Similarly, the cover film 15 may be of single layer or multi-layer construction, preferably having a heat-sealable layer coming into contact with the support sheet to facilitate sealing. Such single layer or multi-layer films of self-welding or heat-sealable type are well known in the art.

Figure 6:
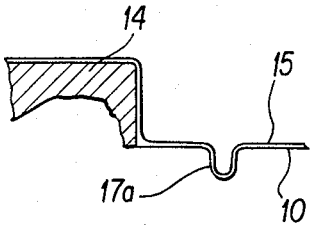
FIG. 6 is a detail, on the same section plane as FIG. 4, but showing a depressed "cover film collector" formation.

FIG. 6 shows an alternative embodiment in which the cover film "collector" formation is defined not by a "dummy product" but instead by a local downwardly deformed region or recess formation 17*a* in the support sheet. Upon vacuum sealing, surplus cover film of the sheet 15 (around the adjacent product article 14) is absorbed in the recess on the upper concave face of depressed formation 17*a* and webbing at the product article 14 is considerably reduced and even substantially eliminated.

Generally the recess type of "collector" formation defines an aperture of adequate size in the support sheet and may simply be a hole in the support sheet.

The process for forming the pack shown in FIG. 6 will be analogous to the process employing upstanding "dummy pack" formations and the "collector" recess or aperture may be preformed or formed in situ in the chamber. The design of suitable apparatus for achieving this is well within the capability of the expert in this art.

As will be readily appreciated, the description given above is merely by way of example and is capable of being varied to a wide degree by the expert skilled in this art, while remaining within the scope of the following claims.

We claim:

1. Apparatus for vacuum packaging comprising:

(a) a vacuum chamber adapted to receive a support sheet and a cover film over the support sheet;

(b) means for evacuating a space between the cover film and support sheet to form a vacuum pack of the cover film sealed to the support sheet around a product article;

(c) upstanding adjustable rib-like means projecting into the chamber once the chamber is closed, said means defining a cover film collector to absorb cover film material which would otherwise form webbing on a product article being packed; and, (d) means for retracting said rib-like means and for extending it into the chamber.

2. Apparatus according to claim 1 wherein said vacuum chamber comprises a flat base having said means defining said upstanding collector formations therein, and a chamber cover defining a cavity which closes onto said base when the chamber is closed.

3. Apparatus according to claim 2 further characterized by including means for feeding a support sheet to the chamber while the chamber is in an open condition; means for feeding a cover film to the chamber while in an open condition; and, means for closing the chamber.

* * * * *